United States Patent [19]

Capron

[11] Patent Number: 4,938,163

[45] Date of Patent: Jul. 3, 1990

[54] BARGE CONNECTOR SYSTEM

[75] Inventor: Mark E. Capron, Oxnard, Calif.

[73] Assignee: The United States of America as represented by the Secretary of the Navy, Washington, D.C.

[21] Appl. No.: 459,180

[22] Filed: Dec. 29, 1989

[51] Int. Cl.[5] ..... B63B 21/04

[52] U.S. Cl. ..... 114/251; 114/219; 114/220; 114/249; 267/141.1; 405/212; 405/213

[58] Field of Search ..... 114/219, 220, 248, 249, 114/250, 251, 252; 405/212, 213, 214, 215; 267/140, 141.1

[56] References Cited

U.S. PATENT DOCUMENTS

| | | | |
|---|---|---|---|
| 1,357,473 | 11/1920 | Ray | 114/250 |
| 2,780,919 | 2/1957 | Carey | 114/219 |
| 3,062,170 | 11/1962 | Verneaux | 114/250 |
| 3,109,406 | 11/1963 | Stockdale | 114/251 |
| 3,672,657 | 6/1972 | Young et al. | 405/212 |
| 3,674,115 | 7/1972 | Young et al. | 405/212 |
| 3,685,662 | 8/1972 | Walker et al. | 405/212 |
| 3,756,184 | 9/1973 | Halto | 114/251 |
| 3,799,100 | 3/1974 | Marriner | 114/250 |
| 3,863,909 | 2/1975 | Weber | 267/140 |
| 3,871,323 | 3/1979 | Roseman et al. | 114/251 |
| 3,954,078 | 5/1976 | Garcia | 114/249 |
| 4,453,487 | 6/1984 | Vinnari | 114/249 |

FOREIGN PATENT DOCUMENTS

| | | | |
|---|---|---|---|
| 140465 | 6/1921 | United Kingdom | 267/141.1 |

*Primary Examiner*—Sherman Basinger
*Assistant Examiner*—Thomas J. Brahan
*Attorney, Agent, or Firm*—David S. Kalmbaugh

[57] ABSTRACT

A barge connecting system for connecting a first vessel to a second vessel comprising three spaced parallel rectangular shaped plates, the first plate of which is attached to the stern of a lead vessel, and the third plate of which abuts or may be attached to the bow of a following vessel. Bracing for the second and third plates is provided by plurality of diagonal wire cables each of which has one end connected to a corner of the first rectangular shaped plate and the opposite end connected to either a corner of the second rectangular shaped plate or a corner of the third rectnagular shaped plate. Positioned vertically between the first and second plates are a first pair of pneumatic fenders which are rotatably mounted on the first plate by wire cables. There is positioned horizontally between the second and third plates a second pair of pneumatic fenders which are mounted on third plate by wire cables. The fenders allow horizontal movement of the second and third plates with respect to the first plate and vertical movement of third plate with respect to the first and second plates. Since the fenders are pneumatic, a surge force generated by the following vessel will be absorbed, the fenders will then expand and the following vessel will return to an equilibrium position with respect to the lead vessel. At least a pair of tow lines are used to connect to stern of the lead vessel to the bow of the following vessel when said third rectangular shaped plate is not attached to the bow of said following vessel.

13 Claims, 3 Drawing Sheets

BARGE CONNECTOR SYSTEM

BACKGROUND OF THE INVENTION

1. Field of the Invention

The present invention relates generally to marine towing devices. In particular, the present invention relates to a connector system by which several barges may be held together in open seas.

2. Description of the Prior Art

Deployable port facilities needed to support both the military's fleet operations and their forces ashore may include large modular facilities mounted on floating barges arranged in close coupled connection. The barge modules are approximately 100 feet wide by 300 feet long and weigh approximately 5000 tons. Module or barge connectors are essential components of these deployable port facilities.

When anchored in a fixed location offshore the connecting arrangement that holds adjacent barges together must be flexible to minimize the forces exerted on the barges and at the same time allow for close coupled connection of the barges with acceptable relative motion for ease of movement of military personnel and equipment on the deployable port facility.

There is also a requirement that the connecting arrangement allow for towing of barges at sea so that the deployable port facility can be moved from location to location. In the past, when one vessel pushed another, for example, when a tug pushed one or more barges, it has been a common practice to interconnect the vessels by rigid structural members in a close-coupled linkage. In inland waterways where maneuverability is important and the water is calm, the use of rigid structural members to connect barges for towing is acceptable although the structural connecting members have been subject to failure because of the stresses caused during towing. In addition, the use of rigid structural members for close-coupled linkage limits control over the barges and the ability to restore the barges to an equilibrium position.

On the open sea, where maneuverability of the barges is not important and sea generated motions are often very large, the tug is often connected to the first barge in a train of barges with relatively long tow lines with the remaining barges in the train being connected together by additional tow lines. Long tow lines are required for shock absorption between the tug and first barge and between successive barges.

However, the use of multiple long tow lines present many disadvantages because the tow lines tend to become fouled and a considerable amount of effort is required to link each tow line to the tug and barges. Also these tow lines create a drag and provide limited capacity for controlling and maneuvering one or more barges at sea.

Accordingly, there is need for an improved connecting arrangement to connect adjacent barges of a deployable port facility anchored at a fixed location and allow for close-coupled ocean towing of large barges which would provide improved control over the towed barges. Such a connecting arrangement should be able to provide control in either a push-tow or a pull-tow situation and be adaptable to towing multiple barges in linear flotilla without the long intermediate tow lines that characterized prior art connecting arrangements. The connecting arrangement should permit relative motions between the barges, including pitch, roll, yaw, sway, surge, and heave while providing yaw, surge, and sway restraining and restoring forces without causing excessive lateral forces.

SUMMARY OF THE INVENTION

In accordance with its purpose, as broadly described, the present invention comprises a close-coupled barge connection system for connecting a first barge to a second barge and includes three spaced parallel rectangular shaped plates, the first plate of which is attached to the stern of a lead vessel, and the third plate of which abuts or may be attached to the bow of a following barge. Bracing for the second and third plates is provided by plurality of diagonal wire cables each of which has one end connected to a corner of the first rectangular shaped plate and the opposite end connected to either a corner of the second rectangular shaped plate or a corner of the third rectangular shaped plate.

Positioned vertically between the first and second plates are a first pair of pneumatic fenders which are connected to the first plate by wire cables. There is positioned horizontally between the second and third plates a second pair of pneumatic fenders which are connected to the third plate by wire cables.

Each fender has a pipe through which the cable passes so as to allow the fender to rotate and thereby allow horizontal movement of the second and third plates with respect to the first plate and vertical movement of third plate with respect to the first and second plates. Since the fenders are pneumatic, a surge force generated by the following barge will be absorbed, the fenders will then expand and the following vessel will return to an equilibrium position with respect to the lead barge. At least a pair of tow lines are used to connect the stern of the lead barge to the bow of the following barge when the third plate abuts and is not attached to the following barge.

DESCRIPTION OF THE PREFERRED EMBODIMENT

The preferred embodiment of the subject invention will now be discussed in conjunction with all of the figures of the drawings.

Figure 1:
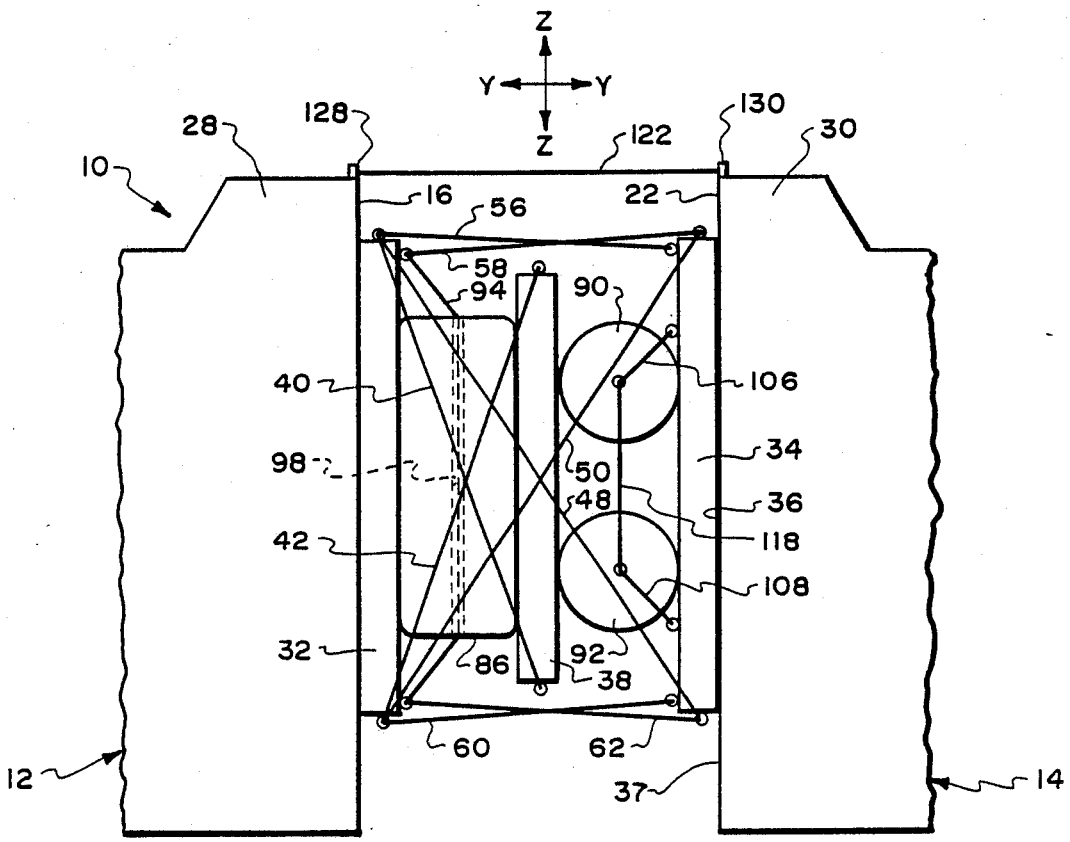
FIG. 1 depicts a schematic side view of the preferred embodiment of the present invention.
Figure 2:
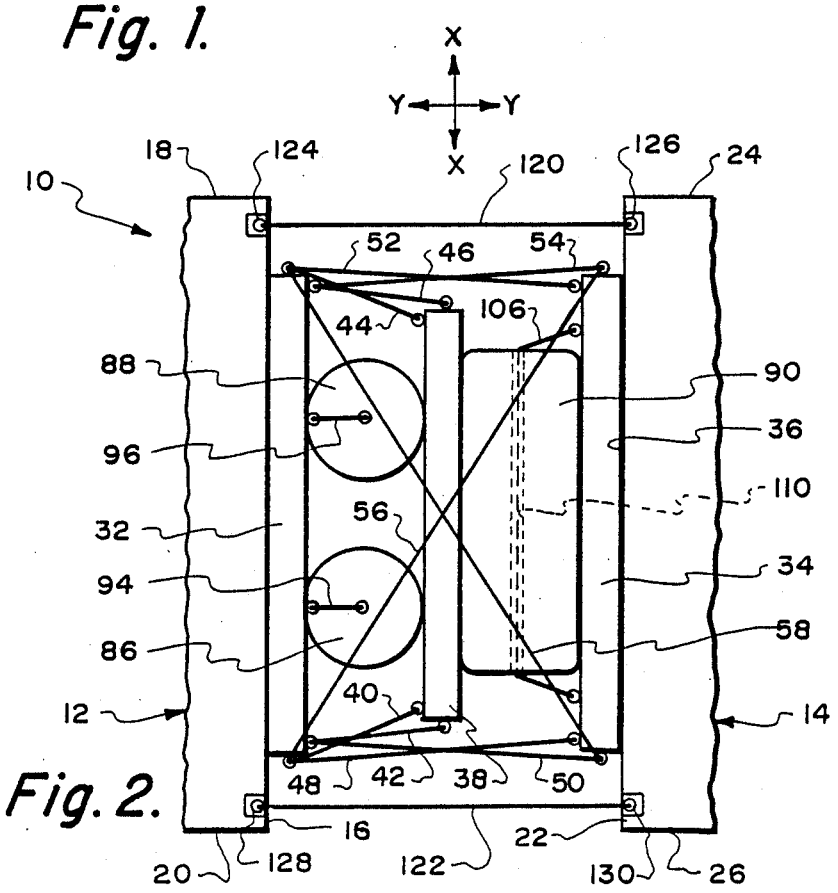
FIG. 2 depicts a schematic top view of the preferred embodiment of the present invention.

Referring first to FIGS. 1 and 2, there is shown a barge connector system, generally 10, connecting a first vessel/barge 12 to a second vessel/barge 14.

Barge 12 is a lead vessel and includes a stern 16, a starboard side 18, and a port side 20. Barge 14 is a following vessel and includes a bow 22, a starboard side 24 and a port side 26. Stern 16 of lead barge 12 includes a pushing knee 28, while bow 22 of following barge 14 includes a pushing knee 30.

On the open sea both the lead barge 12 and the following barge 14 are subjected to the force of the wind, the waves and currents tending to make barges 12 and 14 move linearly or rotationally about their longitudinal, lateral or vertical axis. In pitching, each vessel 12 and 14 rotates, that is, alternately plunge and rise about its lateral axis shown as X in FIG. 2. In rolling, each vessel 12 and 14 rotates about its longitudinal axis which is shown as Y in FIGS. 1 and 2. In yawing, each vessel 12 and 14 will swing to one side or the other from its course, that is, it will rotate about its vertical axis Z in FIG. 1. In heaving each vessel 12 and 14 alternately rises and falls more or less without pitching and rolling, that is, it moves linearly along its vertical axis shown as axis Z in FIG. 1. In swaying each vessel 12 and 14 is displaced sideways back and forth, that is, it moves linearly along its lateral X axis. In surge each vessel 12 and 14 moves linearly along its longitudinal axis Y. The aforenoted three linear motions and three rotational motions define any movement of vessels 12 and 14 from an analytical standpoint.

Referring again to FIGS. 1 and 2 there is shown barge connector system 10 which includes a first rectangular shaped plate 32 attached to the stern 16 of barge 12 by means of welds or bolts, not shown, and a second rectangular shaped plate 34 having a surface 36 which abuts the bow 22 of barge 14 and is allowed to slide against the outer surface 37 of bow 22 in order to reduce shear loads on connector system 10. In the preferred embodiment, plates 32 and 34 measure 20 feet wide by 20 feet long by 1.65 feet thick and are fabricated from steel with a honeycomb structure internally, not shown.

There is located between and positioned approximately parallel to plates 32 and 34, a third rectangular shaped plate 38 which measures 17 feet wide by 17 feet long by 1.65 feet thick and which is likewise fabricated from steel with a honeycombed internal structure.

Bracing to resiliently connect plate 38 to plate 32 is provided by a pair of diagonal wire cables 40 and 42 positioned on the port side 16 of vessel 12 and a pair of wire cables 44 and 46 positioned on the starboard side 16 of vessel 12. Cables 40 and 44 are each connected at one end to the upper end of plate 32 and at their opposite end to the lower end of plate 38, while cables 42 and 46 are each connected at one end to the lower end of plate 32 and at their opposite end to the upper end of plate 38.

Bracing to resiliently connect plate 34 to plate 32 is provided by a pair of diagonal wire cables 48 and 50 positioned on the port side 20 of vessel 12, a pair of diagonal wire cables 52 and 54 positioned on the starboard side 18 of vessel 12, a pair of transverse wire cables 56 and 58 positioned near the top of vessels 12 and 14, and a pair of transverse wire cables 60 and 62 positioned near the bottom of vessels 12 and 14. Cables 48 and 52 are each connected at one end to the upper end of plate 32 and at their opposite end to the lower end of plate 34, while cables 50 and 54 are each connected at one end to the lower end of plate 32 and at their opposite end to the upper end of plate 34. Likewise, cables 56 and 60 are each connected at one end to the port side of plate 32 and at their opposite end to the starboard side of plate 34, while cables 58 and 62 are each connected at one end to the starboard side of plate 32 and at their opposite end to the port side of plate 34.

Figure 3:
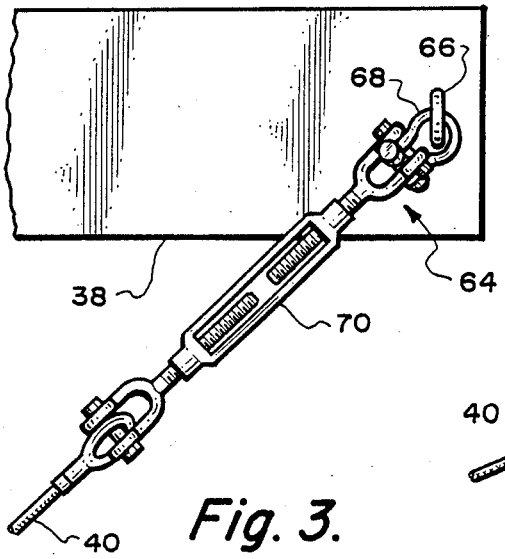
FIG. 3 depicts an enlarged detail side view of a corner of one of the rectangular shaped plates of FIG. 1 having connected thereto one diagonal wire support cable.

Referring now to FIG. 3 there is shown a cable connection means, generally 64, used to connect a single cable to a rectangular shaped plate, for example, the connection of cable 40 to plate 38. Cable connection means 64 includes a flange 66 welded to plate 38 and having an aperture through which the screw pin anchor of an anchor shackle 68 passes. The first eye of a turnbuckle 70 engages anchor shackle 68 while the second eye of turnbuckle 70 engages the eye at the end of cable 40.

Figure 4:
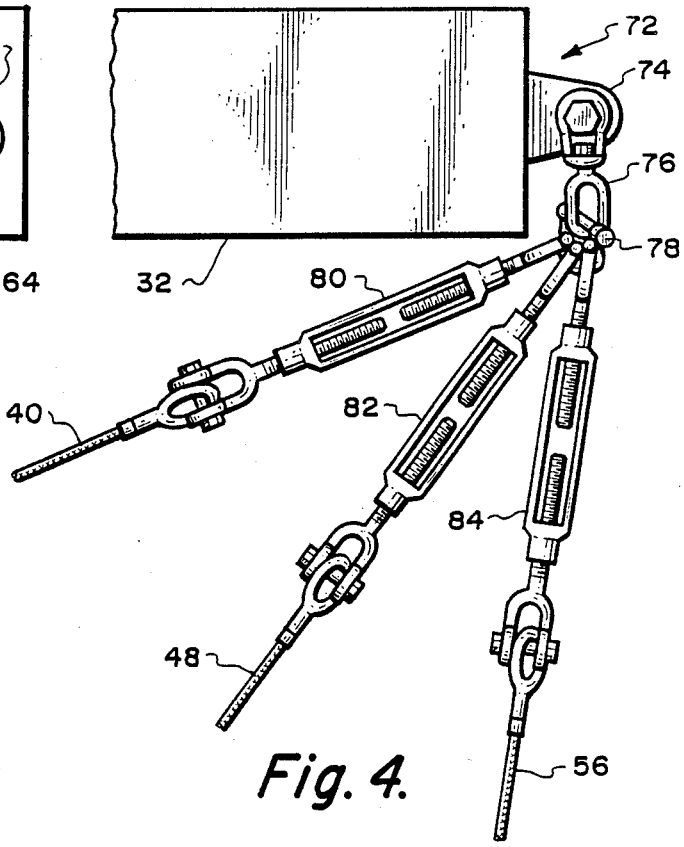
FIG. 4 depicts an enlarged detail side view of a corner of one of the rectangular shaped plates of FIG. 1 having connected thereto three diagonal wire support cables.

Referring to FIG. 4, there is shown a cable connection means, generally 72, used to connected two or more cables to a rectangular shaped plate, for example, the connection of cables 40, 48, and 56 to plate 32. Cable connection means 72 includes a flange 74 welded to plate 32 and having an aperture through which the screw pin anchor of a rotatable shackle 76 passes. There is in movable engagement with shackle 76 an anchor shackle 78 which is, in turn, in movable engagement with the first eyes of a trio of turnbuckles 80, 82, and 84. The second eyes of turnbuckles 80, 82, and 84, in turn, engage respectively the eyes at the end of cables 40, 48, and 56.

The use of turnbuckle 70 as an element of connecting means 64 provides a means whereby the tension of wire cable 40 may by adjusted while the use of anchor shackle 68 as an element of connecting means 64 allows for rotational movement of cable 40 with respect to plate 38. Similarly, the use of turnbuckles 80, 82, and 84 as elements of connecting means 72 respectively, provide a means whereby the tension of wire cables 40, 48, and 56 may be adjusted, while the combination of shackles 76 and 78 as elements of connecting means 72 allow for the rotational movement of cables 40, 48, and 56.

It should be noted that shackles 68, 76, and 78, and turnbuckles 70, 80, 82, and 84 are commercially available from several manufacturers including the Crosby Group, Inc. of Tulsa, Oklahoma.

Referring again to FIGS. 1 and 2 there is located between plates 32 and 38 and positioned vertically along the Z axis a pair of Wellington pneumatic fenders 86 and 88. There is located between plates 34 and 38 and positioned horizontally along the Y axis a second pair of Wellington pneumatic fenders 90 and 92. Each of the aforenoted fenders 86, 88, 90, and 92 measure 5 feet in diameter and are 13.33 feet in length and are commercially available from several manufacturers including SeaWard International, Inc. of Clearbrook, Virginia which uses the trademark Sea Guard Marine Fenders to designate their fenders.

Figure 5:
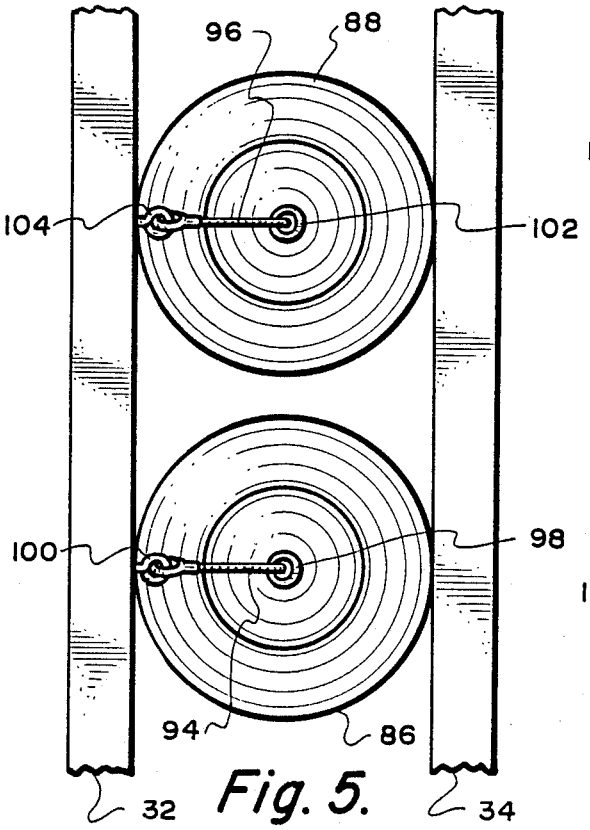
FIG. 5 depicts an enlarged detail top view of the bracing system for the vertical fenders of the present invention.

Referring now to FIGS. 1, 2, and 5 there is shown bracing to resiliently connect fenders 86 and 88 to plate 32 and allow for rotational movement of fenders 86 and 88 with respect to plate 32 which includes a pair of wire cables 94 and 96 for respectively securing fenders 86 and 88 to plate 32. Cable 94 passes through a pipe 98 positioned within fender 86 at the center thereof and has one end connected to a flange 100 welded to the upper end of plate 32 and the opposite end connected to a flange, not shown, welded to the lower end of plate 32. Similarly, cable 96 passes through a pipe 102 positioned within fender 88 at the center thereof and has one end connected to a flange 104 welded to the upper end of plate 32 and the opposite end connected to a flange, not shown, welded to the lower end of plate 32.

Figure 6:
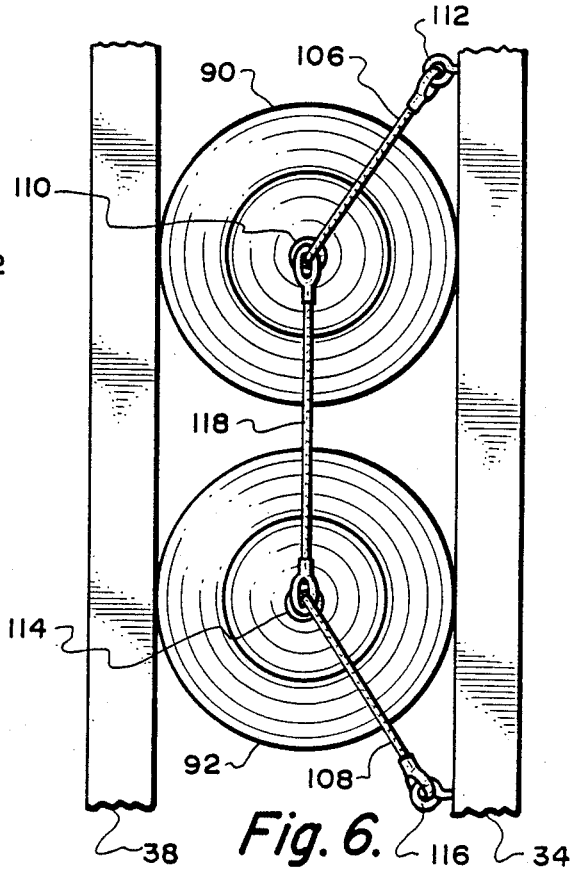
FIG. 6 depicts an enlarged detail side view of the bracing system for the horizontal fenders of the present invention.

Referring now to FIGS. 1, 2, and 6 there is shown bracing to resiliently connect fenders 90 and 92 to plate 34 and allow for rotational movement of fenders 90 and 92 with respect to plate 34 which includes a pair of wire cables 106 and 108 for respectively securing fenders 90 and 92 to plate 34. Cable 106 passes through a pipe 110 positioned within fender 90 at the center thereof and has one end connected to a flange 112 welded near the port side of plate 34 and the opposite end connected to a flange, not shown, welded to the starboard side of plate 34. Similarly, cable 108 passes through a pipe 114 positioned within fender 92 at the center thereof and has one end connected to a flange 116 welded near the port side of plate 34 and the opposite end connected to a flange, not shown, welded to the starboard side of plate 34. There is connected between cables 106 and 108 and positioned adjacent the port end of fenders 90 and 92 a wire cable 118. Although not illustrated, there is similarly connected between cables 106 and 108 and positioned adjacent the starboard end of fenders 90 and 92 a second wire cable.

At this time it should be noted that fenders 86, 88, 90 and 92 will rotate only when there is slack in the cable which secures the fender either to plate 32 or 34. If the cable is taut the fender will not rotate. For example, referring to FIG. 7 when a force raises vessel 14 with respect to vessel 12, cables 50 and 54, FIG. 2, become taut resulting in plate 34 being pulled toward plate 32 which, in turn, flattens fenders 90 and 92 thereby producing slack in cables 90 and 92 and allowing fenders 106 and 108 to rotate in a counterclockwise direction.

Referring again to FIGS. 1 and 2 a pair of tow lines 120 and 122 are used to connect barges 12 and 14 for close coupled ocean towing. Tow line 120 is connected at one end to a deck pad 124 mounted on the starboard side 18 of vessel 12, while the opposite end is connected to a deck pad 126 mounted on the starboard side 24 of vessel 14. Tow line 122 is connected at one end to a deck pad 128 mounted on the port side 20 of vessel 12, while the opposite end is connected to a deck pad 130 mounted on the port side 26 of vessel 12. While the preferred embodiment of the present invention illustrates the use of only two tow lines to connect vessel 12 to vessel 14, it is to be understood that large vessel may require the use of more than two tow lines to effectively connect a lead vessel to a following vessel.

In operation, when following vessel 14 is given a surging force which tends to force it ahead of its normal relative position with respect to lead vessel 12, pneumatic fenders 86, 88, 90 and 92 will compress and absorb energy to limit the amount of relative surge that will occur. As soon as the surging force acting on following vessel 14 is absorbed, pneumatic fenders 86, 88, 90 and 92 will begin expanding to their preloaded condition and bring following vessel 14 back toward the equilibrium position with respect to lead vessel 12.

Figure 7:
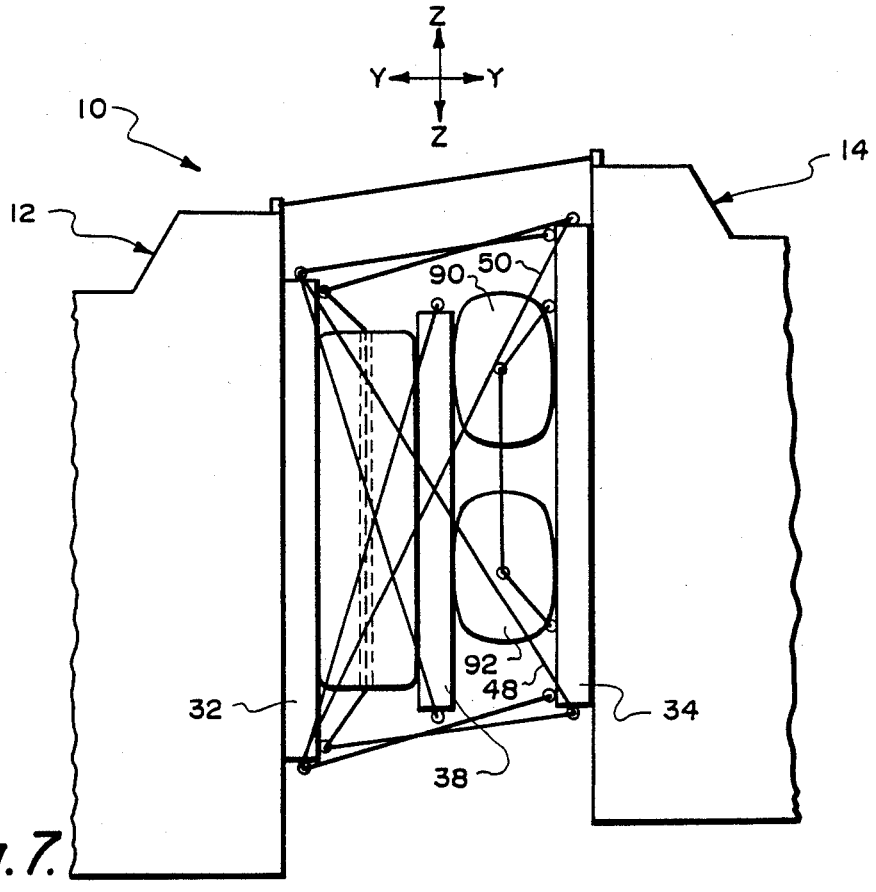
FIG. 7 is a schematic side view illustrating vertical motion of the barge connector of FIG. 1.

Referring now to FIG. 7, there is shown vessel 14 rising with respect to vessel 12, that is vessel 14 is rising linearly along its Z axis. As shown in FIG. 7, this movement of vessel 14 flattens fenders 90 and 92 producing slack in cables 106 and 108 thereby allowing fenders 90 and 92 to rotate in a counterclockwise direction which, in turn, allows plate 34 to move linearly along the Z axis with respect to plates 32 and 38. Diagonal wire cables 50 and 54, FIG. 2, are under tension and limit the heave of following vessel 14 toward the upper end of lead vessel 12. As soon as the heave force is absorbed, cables 50 and 54 will begin returning plate 34 to its normal position. This, in turn, results in following vessel 14 returning to its normal position with respect to lead vessel 12.

Figure 8:
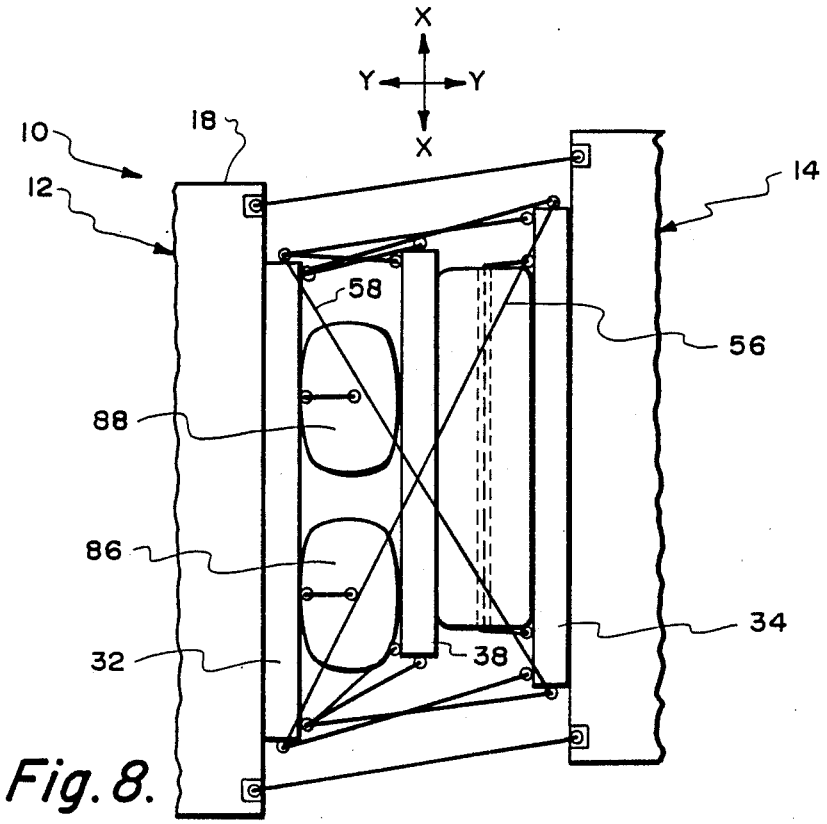
FIG. 8 is a schematic top view illustrating horizontal motion of the barge connector of FIG. 1.

Referring now to FIG. 8, there is shown vessel 14 being displaced sideways with respect to vessel 12 by a sway force, that is vessel 14 is moving linearly along its lateral X axis. As shown in FIG. 8, this displacement of vessel 14 with respect to vessel 12 flattens fenders 86 and 88 which produces slack in cables 94 and 96 thereby allowing rotation of fenders 86 and 88 in a counterclockwise direction which allows plates 34 and 38 to move linearly along the X axis with respect to plate 32. Diagonal wire cables 56 and 60, FIG. 1, are under tension and limit the amount of sway of following vessel 14 toward the starboard side 18 of lead vessel 12. As soon as the sway force is absorbed, cables 56 and 60 will begin returning plate 34 to its normal position. Plate 34 will exert a force on plate 38 causing fenders 86 and 88 to rotate in a clockwise direction so as to move plate 38 to the port side 20 of vessel 12 and return plate 38 to its normal position. This, in turn, results in following vessel 14 returning to its normal position directly behind lead vessel 12.

Referring again to FIGS. 1 and 2 an alternative embodiment of the present invention has plate 34 attached by means of bolts, not shown, to bow 22 of barge 14. In this embodiment of barge connector system 10 tow lines 120 and 122 are optional, that is barge connector system 10 would function adequately without tow lines 120 and 122. In this embodiment tension loads are carried by diagonal wire cables 48, 50, 56, 58, 60 and 62.

From the foregoing, it may readily be seen that the subject invention comprises a new, unique, and exceedingly useful barge connecting system which constitutes a considerable improvement over the known prior art. Obviously, many modifications and variations of the present invention are possible in light of the above teachings. It is, therefore, to be understood that within the scope of the appended claims, the invention may be practice otherwise than as specifically described.

What is claimed is:

1. A system for connecting a lead barge to a following barge comprising:

means for connecting the stern of said lead barge to the bow of said following barge;

first, second and third spaced rectangular shaped plates, the first plate of which has one surface thereof attached to the stern of said first barge and third plate of which has one surface thereof abutting the bow of said second barge;

first pneumatic fender means positioned between said first and second plates for allowing said second and third plates to move along a first axis which is approximately parallel to either surface of said first plate;

second pneumatic fender means positioned between said second and third plates for allowing movement of said third plate along a second axis which approximately parallel to either surface of said first plate and perpendicular to said first axis;

said first and second fender means being adapted to absorb a surging force exerted by said following barge upon said lead barge; and bracing means for resiliently connecting said second and third plates to said first plate.

2. The system of claim 1 wherein said connecting means comprises at least a pair of tow lines, each of which has one end thereof connected to the stern of said first barge and the opposite end thereof connected to the bow of said second barge.

3. The system of claim 1 wherein said first pneumatic fender means comprises a first pair of pneumatic fenders positioned vertically between said first and second plates.

4. The system of claim 1 wherein said second pneumatic fender means comprises a second pair of pneumatic fenders positioned horizontally between said second and third plates.

5. The system of claim 1 wherein said bracing means comprises:

a first pair of diagonal cables for resiliently connecting the port sides of said first and second plates;

a second pair of diagonal cables for resiliently connecting the port sides of said first and third plates;

a third pair of diagonal cables for resiliently connecting the starboard sides of said first and second plates;

a fourth pair of diagonal cables for resiliently connecting the starboard sides of said first and third plates;

a first pair of transverse cables for resiliently connecting the port side of said first plate to the starboard side of said second plate; and a second pair of transverse cables for resiliently connecting the starboard side of said first plate to the port side of second plate.

6. The system of claim 6 further characterized by a means for connecting the end of any of said diagonal or transverse cables to one of said rectangular shaped plates, said cable connecting means comprising:

a flange attached to said rectangular shaped plate, said flange having an aperture;

an anchor shackle having a screw pin anchor, said screw pin anchor passing through the aperture of said flange; and a turnbuckle having a pair of eyes, the first eye of which engages said anchor shackle and the second eye of which engages an eye at one end of said cable.

7. A barge connecting system for connecting a first barge to a second barge comprising:

at least a pair of tow lines, each of which has one end thereof connected to said first barge and the opposite end connected to said second barge;

first, second and third spaced rectangular shaped plates, the first plate of which has one surface thereof attached to the stern of said first barge and third plate of which has one surface thereof abutting the bow of said second barge;

a first pair of pneumatic fenders rotatably mounted on the other surface of said first plate and positioned between said first and second plates so as to allow said second and third plates to move along a first axis which is approximately parallel to either surface of said first plate;

a second pair of pneumatic fenders rotatably mounted on the other surface of said third plate and positioned between said second and third plates for allowing movement of said third plate along a second axis which approximately parallel to either surface of said first plate and perpendicular to said first axis;

a first pair of diagonal cables for resiliently connecting the port sides of said first and second plates;

a second pair of diagonal cables for resiliently connecting the port sides of said first and third plates;

a third pair of diagonal cables for resiliently connecting the starboard sides of said first and second plates;

a fourth pair of diagonal cables for resiliently connecting the starboard sides of said first and third plates;

a first pair of transverse cables for resiliently connecting the port side of said first plate to the starboard side of said second plate; and a second pair of transverse cables for resiliently connecting the starboard side of said first plate to the port side of second plate.

8. The barge connecting system of claim 7 wherein said first axis is the X axis and said axis is the Z axis.

9. The barge connecting system of claim 7 wherein each of said pneumatic fenders has a pipe positioned at the center thereof through which a cable passes so as to allow rotation of said fender with the each end of said cables passing through said first pair of fenders being connected to said first plate and each end of said wire cables passing through said second pair of wire cables being connected to said third plate.

10. The barge connecting system of claim 7 further characterized by means for connecting the end of any of said diagonal or transverse cables to one of said rectangular shaped plates, said cable connecting means comprising:

a flange attached to said rectangular shaped plate, said flange having an aperture;

an anchor shackle having a screw pin anchor, said screw pin anchor passing through the aperture of said flange; and a turnbuckle having a pair of eyes, the first eye of which engages said anchor shackle and the second eye of which engages an eye at one end of said cable.

11. A barge connecting system for connecting a first barge to a second barge comprising:

first, second and third spaced rectangular shaped plates, the first plate of which has one surface thereof attached to the stern of said first barge and third plate of which has one surface thereof attached to the bow of said second barge;

a first pair of pneumatic fenders rotatably mounted on the other surface of said first plate and positioned between said first and second plates so as to allow said second and third plates to move along a first axis which is approximately parallel to either surface of said first plate;

a second pair of pneumatic fenders rotatably mounted on the other surface of said third plate and positioned between said second and third plates for allowing movement of said third plate along a second axis which approximately parallel to either surface of said first plate and perpendicular to said first axis;

a first pair of diagonal cables for resiliently connecting the port sides of said first and second plates;

a second pair of diagonal cables for resiliently connecting the port sides of said first and third plates;

a third pair of diagonal cables for resiliently connecting the starboard sides of said first and second plates;

a fourth pair of diagonal cables for resiliently connecting the starboard sides of said first and third plates;

a first pair of transverse cables for resiliently connecting the port side of said first plate to the starboard side of said second plate; and a second pair of transverse cables for resiliently connecting the starboard side of said first plate to the port side of second plate.

12. The barge connecting system of claim 11 wherein each of said pneumatic fenders has a pipe positioned at the center thereof through which a cable passes so as to allow rotation of said fender with the each end of said cables passing through said first pair of fenders being connected to said first plate and each end of said wire cables passing through said second pair of wire cables being connected to said third plate.

13. The barge connecting system of claim 11 further characterized by means for connecting the end of any of said diagonal or transverse cables to one of said rectangular shaped plates, said cable connecting means comprising:

a flange attached to said rectangular shaped plate, said flange having an aperture;

an anchor shackle having a screw pin anchor, said screw pin anchor passing through the aperture of said flange; and a turnbuckle having a pair of eyes, the first eye of which engages said anchor shackle and the second eye of which engages an eye at one end of said cable.

* * * * *